US006511520B1

(12) United States Patent
Eber et al.

(10) Patent No.: US 6,511,520 B1
(45) Date of Patent: Jan. 28, 2003

(54) ADDITIVE FOR FUEL OILINESS

(75) Inventors: Daniele Eber, Lyons (FR); Laurent Germanaud, Heyraux (FR); Paul Maldonado, Saint Symphorien d'Ozon (FR)

(73) Assignee: Elf Antar France, Courbevoie (FR)

( * ) Notice: Subject to any disclaimer, the term of this patent is extended or adjusted under 35 U.S.C. 154(b) by 0 days.

(21) Appl. No.: 09/355,992

(22) PCT Filed: Dec. 22, 1998

(86) PCT No.: PCT/FR98/02823

§ 371 (c)(1),
(2), (4) Date: Oct. 28, 1999

(87) PCT Pub. No.: WO95/03377

PCT Pub. Date: Feb. 2, 1995

(30) Foreign Application Priority Data

Dec. 24, 1997 (FR) ..... 97 16538
Mar. 17, 1998 (FR) ..... 98 03225

(51) Int. Cl.[7] ..... C10L 1/18; C10L 1/22
(52) U.S. Cl. ..... 44/388; 44/389; 44/394; 44/306; 44/308
(58) Field of Search ..... 44/388, 389, 394, 44/306, 308

(56) References Cited

U.S. PATENT DOCUMENTS 2,363,778 A * 11/1944 Pedersen ..... 44/333
3,133,104 A * 5/1964 Johnston et al. ..... 44/308
3,969,233 A * 7/1976 Lucas ..... 508/388
4,308,200 A * 12/1981 Fremont ..... 260/110
4,344,771 A * 8/1982 Bonazza et al. ..... 44/308
4,504,280 A * 3/1985 Efner et al. ..... 44/306
4,617,026 A * 10/1986 Shaub et al. ..... 44/389
4,634,452 A * 1/1987 Secor ..... 44/308
4,810,262 A * 3/1989 Lewtas ..... 44/333
5,000,759 A * 3/1991 Nalesnik et al. ..... 44/333
5,454,842 A * 10/1995 Poirier et al. ..... 44/324
5,578,090 A * 11/1996 Bradin ..... 44/308
5,705,722 A * 1/1998 Monnier et al. ..... 585/240

FOREIGN PATENT DOCUMENTS

JP 06065528 * 3/1994
WO WO 96-18706 * 6/1996

OTHER PUBLICATIONS

JP–06065528A English Abstract, Aug. 3, 1994.*
Lubricants, and Fossil Fuels, vol. 05.01, Petroleum Products & Lubricants(I)D–56–1660, p. 453–460, *1984 Annual Book of ASTM Standards,* Section 5, Petroleum Products, 1984.*

* cited by examiner

*Primary Examiner*—Margaret Medley
(74) *Attorney, Agent, or Firm*—Oblon, Spivak, McClelland, Maier & Neustadt, P.C.

(57) ABSTRACT

The invention concerns an additive for motive fuel additive, in particular with low sulphur content not more than 500 ppm, consisting for the most part of a combination comprising 5 to 95 wt. % of a glycerol monoester $R_1$—C(O)—O—$CH_2$—CHO—$CH_2$OH or $R_1$—C(O)—O—CH($CH_2OH)_2$, $R_1$ being an alkyl chain containing 8 to 60 carbon atoms, or a monocyclic or polycyclic group comprising 8 to 60 carbon atoms, and from 5 to 95 wt % of a compound of formula $R_2$—C(O)—X, $R_2$ being an alkyl chain containing 8 to 24 carbon atoms, or a monocyclic or polycyclic group comprising 8 to 60 carbon atoms, and X being selected among (i) the groups $OR_0$, $R_0$ being a hydrocarbon radical comprising 1 to 8 carbon atoms, optionally substituted by one or several esters; and (ii) the groups derived from primary or secondary amines and alkanolamines with aliphatic hydrocarbon chain, comprising 1 to 18 carbon atoms.

19 Claims, No Drawings

ADDITIVE FOR FUEL OILINESS

The present application is a 371 of PCT/FR98/02823 filed Dec. 22, 1998.

BACKGROUND OF THE INVENTION

Field of the Invention

The present invention relates to a fuel containing a lubricity additive for improving the lubrication properties of fuels, whether ground vehicle engine fuel (diesel) or jet fuel, and more particularly of diesel fuels with a low sulphur content.

It is well known that diesel fuels and jet fuels must have lubricating capabilities, for the protection of pumps, injection systems and any moving part with which these products come into contact in an internal combustion engine. With the intention of employing products which are increasingly pure and non-polluting, in particular devoid of sulphur, the refining industry has been led increasingly to improve its treatment processes for the removal of sulphur compounds. However, it has been observed that on losing sulphur compounds, the aromatic and polar compounds often associated were also lost, which caused a loss in the lubricating power of these fuels. Thus, beyond certain contents, the elimination of sulphur compounds from the composition of these products very substantially promotes the phenomena of wear and of failure of moving components in pumps and in injection systems. As regulations in many countries have imposed a limitation on the acceptable upper content of sulphur compounds in fuels of 0.05% by weight, in order to lower the emissions of polluting combustion gases from cars, lorries or buses, especially in urban built-up areas, these lubricating compounds must be replaced by other compounds which are non-polluting with regard to the environment but exhibit a sufficient lubricating power to avoid the risks of wear.

The literature also mentions that petrol fuels with a low sulphur content have a lubricating power which can prove to be insufficient to ensure good lubrication of the injection systems in new vehicles and can bring about a premature risk of wear.

Several types of additives have already been provided in order to solve this problem. Thus, antiwear additives have been added to diesel fuels, some of these additives being known in the field of lubricants, of the type of unsaturated fatty acid dimers and fatty acid esters, aliphatic amines, esters of fatty acids and of diethanolamine, and long-chain aliphatic monocarboxylic acids, such as described in U.S. Pat. Nos. 2,527,889, 4,185,594, 4,204,481 and 4,208,190. The majority of these additives exhibit a sufficient lubricating power but at concentrations which are much too high, which is very unfavourable economically for purchasing. In addition, additives containing dimeric acids, like those containing trimeric acids, cannot be employed in fuels feeding vehicles in which the fuel can be in contact with the lubricating oil, because these acids form, by chemical reaction with the detergents usually employed in lubricants, deposits which can accelerate the wear processes.

U.S. Pat. No. 4,609,376 recommends the use of antiwear additives obtained from esters of mono- and polycarboxylic acids and of polyhydroxylated alcohols in fuels containing alcohols in their composition.

In Patent GB 2,307,246, the product resulting from the reaction of carboxylic acid containing 10 to 60 carbon atoms, chosen from fatty acids or fatty acid dimers, with an alkanolamine, obtained by condensation of an amine or of a polyamine with an alkylene oxide, is preferred as lubricity additive.

It is preferable, in Patent GB 2,307,247, to employ an acid derivative, substituted by a least one hydroxyl group or one ester of polyols, or alternatively an amide of this acid.

Another route chosen is to introduce vegetable oils or their esters into the fuels, in order to improve their lubricating power or their lubricity. These include rapeseed, linseed, soybean and sunflower oils or their esters (see Patents EP 635,558 and EP 605,857). However, one of the major disadvantages of these esters is their low lubricating power at a concentration of less than 0.5% by weight in the fuels.

The present invention aims to solve the problems encountered with the additives provided by the prior art, that is to say to improve the lubricating power of the desulphurized and partially dearomatized fuels, while remaining compatible with the other additives, in particular detergents, and the lubricating oils, in particular in not forming deposits, and while reducing the cost price, in particular by a lower additive content of markedly less than 0.5.

The subject of the present invention is the use as lubricity additive for improving the lubricating power of diesel and aviation fuels with a low sulphur content, that is to say with a sulphur content of less than or equal to 500 ppm, characterized in that the additive is composed of:

1) from 5 to 25% by weight of at least one glycerol monoester of following formula ($I_A$) or ($I_B$):

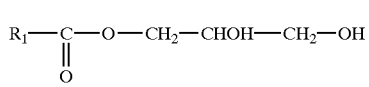

($I_A$)

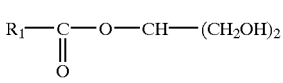

($I_B$)

with $R_1$ chosen saturated or unsaturated, linear or slightly branched, alkyl chains comprising from 8 to 24 carbon atoms and cyclic and polycyclic groups comprising from 8 to 60 carbon atoms;

2) from 35 to 75% by weight of at least one compound of formula (II) below:

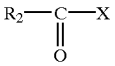

(II)

$R_2$ is a saturated or unsaturated, linear or slightly branched, alkyl chain comprising from 8 to 24 carbon atoms or a cyclic or polycyclic group comprising from 8 to 60 carbon atoms and X is chosen from (i) the groups $OR_0$, wherein $R_0$ being a hydrocarbon residue comprising from 1 to 8 carbon atoms, optionally substituted by one or more ester groups, and (ii) the groups deriving from primary and/or secondary amines or from alkanolamines with a linear or branched aliphatic hydrocarbon chain comprising from 1 to 18 carbon atoms, and 3) from 0.1 to 20% by weight, preferably from 5 to 20% by weight, of at least one glycerol diester of formula ($III_A$) and/or ($III_B$):

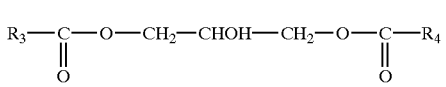

(III$_A$)

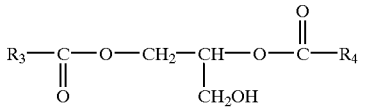

(III$_B$)

in which $R_3$ and $R_4$, which are identical or different, are chosen saturated or unsaturated, linear or slightly branched, alkyl chains comprising from 8 to 24 carbon atoms and cyclic and polycyclic groups comprising from 8 to 60 carbon atoms.

Preference is given, among the glycerol monoesters of formula (I) and the diesters of formula (III) with, respectively, $R_1$ or $R_3$ and $R_4$ consisting of an alkyl chain, to the monoesters and diesters obtained from the oils of the group composed of lauryl oils originating from copra or palm, which are rich in saturated alkyl chains containing 12 to 14 carbon atoms, palmitic oils resulting from palm, lard or tallow, containing a major amount of saturated alkyl chains containing 16 carbon atoms, linoleic oils resulting from sunflower, maize or rape, containing a high content of linoleic acid, linolenic oils from linseed, comprising significant contents of triunsaturated alkyl chains containing from up to 18 carbon atoms, and ricinoleic oils resulting from the castor oil plant.

Among the glycerol monoesters and diesters obtained from polycyclic acids, the preferred monoesters and diesters comprise an $R_1$ or $R_3$ and/or $R_4$ composed of at least two rings, each formed of 5 to 6 atoms, at most one of which is optionally a heteroatom, such as nitrogen or oxygen, and the others are carbon atoms, these two rings additionally having two carbon atoms in common, preferably vicinal, these said rings being saturated or unsaturated. These are preferably glycerol monoesters of natural resin acids obtained from the residues from the distillation of natural oils extracted from resinous trees, in particular resinous conifers.

Among these esters of resin acids according to the invention, preference is given to esters of abietic acid, of dihydroabietic acid, of tetrahydroabietic acid, of dehydroabietic acid, of neoabietic acid, of pimaric acid, of laevopimaric acid and of parastrinic acid.

By adjusting the operating conditions for partial hydrolysis of these oils, it is possible directly to obtain the mixture of glycerol monoalkyl esters/dialkyl esters.

According to another form of the invention, it is possible to prepare glycerol alkyl esters by an esterification reaction between the carboxylic acids described above and glycerol.

The esters and the amides of formula (II) can be easily obtained by reaction of an alcohol, amine and/or alkanolamine compound with an organic acid, such as oleic acid, or a simple ester, such as methyl oleate, the reaction being carried out under the conditions known per se by a person skilled in the art for esterification and amidation processes.

In a first embodiment, the alcohols used to obtain the compound (II) are chosen from the group composed of methanol, ethanol, propanol, isopropanol, butanol, isobutanol, pentanol or 2-ethylhexanol, and/or oxyalkylated alcohols of formula $R(O—CH_2—CHR')_n—OH$, in which R is an alkyl group containing 1 to 6 carbon atoms, R' is hydrogen or an alkyl group containing 1 to 4 carbon atoms and n an integer varying from 1 to 5, such as methyl cellosolve, butyl cellosolve, butyl digol and 1-butoxypropanol.

In a second embodiment, the primary or secondary amines used to obtain the compound (II) are chosen from the group composed of methylamine, ethylamine, propylamine, butylamine, isobutylamine, 2-ethylhexylamine, decylamine, dodecylamine, stearylamine and oleylamine, N,N-diethylamine, N,N-dipropylamine, N,N-dibutylamine, N,N-di(2-ethylhexyl)amine, methyldecylamine, N-methyldodecylamine and N-methyloleylamine.

In a third embodiment, for the compound (II), use is made of alkanolamines chosen from amines containing 1 to 18 carbon atoms substituted by at least one hydroxylated, hydroxymethylated, hydroxyethylated or hydroxypropylated group, such as ethanolamine, diethanolamine, triethanolamine, isopropanolamine, diisopropanolamine, triisopropanolamine, N-methylethanolamine, tris (hydroxymethyl)aminomethane, (N-hydroxyethyl) methylimidazoline or (N-hydroxyethyl) heptadecenylimidazoline.

The additives obtained by physical mixing according to the invention are used to improve the lubricating power of diesel fuels for ground vehicle engines, optionally as a mixture with at least one oxygen-containing compound chosen from the group formed by alcohols, ethers and esters, as well as with any additive used to improve the quality of fuel, such as detergent, dispersing, antioxidizing and anti-foaming additives or even biofuel.

A second subject of the invention corresponds to the fuels containing between 25 and 2500 ppm and preferably from 100 to 1000 ppm by weight of at least one additive used according to the invention dispersed in a diesel fuel which are defined by ASTM standard D-975.

The examples below are given by way of illustration of the invention but do not limit the scope thereof.

EXAMPLE I:

The object of the present example is to compare the lubricating power of the lubricity additives according to the invention with that of the known lubricity additives with regard to wear under the HFRR (High Frequency Reciprocating Rig) test conditions, as is described by the standardized procedure CEC-F06-A96 in the SAE 932692 article by J. W. Hadley of the University of Liverpool.

The additives according to the invention will be referenced $X_i$, while the comparative additives will be referenced $T_i$.

A first additive $T_1$ is the product of the reaction of oleic acid with diethanolamine. This reaction is carried out in a 500 ml four-necked round-bottomed flask into which are introduced first 84.6 g of oleic acid and 105.3 g of xylene and then 31.5 g of diethanolamine over a period of 10 minutes. The entire mixture is subsequently maintained under reflux in xylene for 6 hours in order to remove 6.4 ml of water. The final product obtained contains 50% of active material with an orangey-yellow colour. Analysis by infrared spectroscopy exhibits absorption bands at 3500 $cm^{-1}$, at 1730 $cm^{-1}$ and at 1650 $cm^{-1}$, corresponding respectively to the hydroxyl, ester and amide functional groups.

The second additive $T_2$ is the product of the reaction of a tall-oil acid and of diethanolamine. The tall-oil acid used is a combination of 70% of a mixture of fatty acids (55% oleic acid, 38% linoleic acid, 5% palmitic acid and 2% of linolenic acid) and of 30% of resin acids exhibiting an acid number of 185 mg of KOH per gram. The reaction is carried out as for $T_1$ by introducing 80 g of tall-oil acid, 28.2 g of diethanolamine and 98.6 g of xylene successively into the round-bottomed flask and by maintaining reflux in xylene for 6 hours. The final reaction product is a clear, viscous, orangey-yellow liquid having a residual acid number of 0.21 mg of KOH per gram.

The third additive $T_3$ is a mixture of glycerol alkyl esters, mono-, di- and trialkyl esters, mainly comprising glycerol monooleate.

The first additive according to the invention $X_1$ is a physical mixture of 2 g of the additive $T_2$ and 1 g of the additive $T_3$.

The second additive according to the invention $X_2$ is a physical mixture of 2 g of the additive $T_1$ and 1 g of the additive $T_3$.

The additive $T_4$ is the glycerol trioleate sold by the company Fluka.

The third additive according to the invention $X_3$ is the product of the reaction of gylcerol trioleate $T_4$ with diethanolamine. The reaction is carried out in a four-necked round-bottomed flask, as for $T_1$, by mixing 80 g of glycerol trioleate and 18.5 g of diethanolamine and by then heating the entire mixture at 150° C. for 4 hours.

The additive $T_5$ is a soybean triglyceride oil with an average molecular mass of approximately 870, composed of 28% of oleic acid, 50% of linoleic acid, 8% of linolenic acid, 3% of stearic acid, 10% of palmitic acid and 1% of arachidic acid.

The fourth additive according to the invention $X_4$ is the product of the reaction of 87 g of $T_4$ with 21 g of diethanolamine, the mixture being kept stirred at 150° C. for 6 hours. The additive $X_4$ is a fluid, orangey-yellow liquid exhibiting, by infrared spectrometry, the absorption bands characteristic of the alcohol, ester and amide functional groups.

The fifth additive according to the invention $X_5$ is obtained under the same conditions as the additive $X_4$ but by using 87 g of $T_4$ and 15.75 g of diethanolamine.

The sixth additive according to the invention $X_6$ is obtained under the same conditions as the additive $X_4$ but by using 27 g of the additive $T_5$ and 26 g of diethanolamine.

The seventh additive according to the invention $X_7$ is obtained under the same conditions as the additive $X_4$ but by replacing diethanolamine by 24 g of tris(hydroxymethyl) aminomethane.

The eighth additive according to the invention $X_8$ is obtained under the same conditions as the additive $X_4$ but by using, as triglyceride, castor oil with an average molecular mass of approximately 927 composed of 87% of ricinoleic acid, 7% of oleic acid and 3% of stearic acid.

Each of the additives described above is introduced into three different diesel oils A, B and C, the characteristics of which are given in Table I below, at a content of 100 ppm of active material.

TABLE I

| | | Diesel oil A | Diesel oil B | Diesel oil C |
|---|---|---|---|---|
| Distillation (NFM 07-022) | | 183 | 165 | 168.5 |
| Point, initial | | | | |
| Point at | 10% volume | 227 | 208.5 | 208 |
| | 20% volume | 247 | 227.5 | 226 |
| | 50% volume | 290 | 276 | 274.5 |
| | 80% volume | 334 | 317.5 | 317 |
| | 90% volume | 354 | 334 | 336 |
| Point, final | | 373 | 357.5 | 364 |
| Density at 15° C. (NFT 60-172) | | 0.8508 | 0.8360 | 0.8364 |

TABLE I-continued

| | Diesel oil A | Diesel oil B | Diesel oil C |
|---|---|---|---|
| Calculated cetane number (ASTM D4737) | 51.3 | 50 | 53 |
| % Sulphur (ppm) | 480 | 270 | 455 |
| HFRR lubricating power (CEC F06A96) (μm) | 425 | 772 | 550 |

The diesel oils A, B and C, thus treated with additives, were subjected to the HFRR test, which consists in jointly applying, to a steel ball in contact with a motionless metal plate, a pressure corresponding to a weight of 200 g and an alternating movement of 1 mm at a frequency of 50 Hz. The moving ball is lubricated by the test composition. The temperature is maintained at 60° C. throughout the duration of the test, that is to say 75 min. The lubricating power is expressed by the mean value of the diameters of the wear imprint of the ball on the plate. A small wear diameter indicates a good lubricating power; conversely, a large wear diameter expresses a power which becomes increasingly insufficient as the wear diameter increases.

TABLE II

| | DIESEL OIL 1 | | DIESEL OIL 2 | | DIESEL OIL 3 | |
|---|---|---|---|---|---|---|
| ADDITIVES | Wear diameter (μm) | Gain (%) | Wear diameter (μm) | Gain (%) | Wear diameter (μm) | Gain (%) |
| Without additive | 425 | | 712 | | 550 | |
| $T_1$ | 335 | 21 | 618 | 20 | 456 | 17 |
| $T_2$ | 320 | 25 | 695 | 10 | 470 | 15 |
| $T_3$ | 360 | 15 | 633 | 18 | 430 | 22 |
| $X_1$ | 301 | 29 | 525 | 32 | 396 | 28 |
| $X_2$ | 299 | 30 | 553 | 28 | 439 | 20 |
| $T_4$ | 420 | 1 | 820 | −6 | — | — |
| $X_3$ | 304 | 28 | 526 | 32 | 435 | 21 |
| $T_5$ | 410 | 4 | 750 | 3 | 545 | 1 |
| $X_4$ | 291 | 32 | 501 | 35 | 405 | 26 |
| $X_5$ | 308 | 28 | — | — | 442 | 20 |
| $X_6$ | 258 | 39 | 562 | 27 | 409 | 26 |
| $X_7$ | 331 | 22 | 444 | 42 | 440 | 20 |
| $X_8$ | 300 | 30 | 526 | 32 | 404 | 26 |

It is found, from this Table II, that the physical mixtures according to the invention, such as $X_1$ and $X_2$, have wear characteristics which are smaller and thus clearly better than those of $T_1$, $T_2$ and $T_3$, which expresses the synergistic effect obtained by combination of the predominant components of the lubricity additive according to the invention. $X_3$ corresponds to the reaction product obtained according to the process of the invention from diethanolamine with glycerol trioleate. As above, the advantage of the additive thus obtained with regard to the wear characteristics obtained with $T_4$ is perceived.

The performances of the additives $X_4$, $X_5$, $X_6$ and $X_7$ are to be compared with those of the starting oil $T_5$. As above, the combination of the reaction products limits the wear phenomena observed in the case of the oil alone.

What is claimed is:

1. A fuel suitable for use in a diesel and/or aviation engine, having a sulphur content of less than or equal to 500 ppm, and comprising an additive which comprises:

from 5 to 25% by weight of at least one glycerol monoester of following formulae ($I_A$) or ($I_B$):

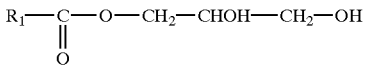

(I$_A$)

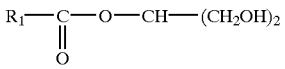

(I$_B$)

wherein $R_1$ is selected from the group consisting of saturated or unsaturated, linear or slightly branched, alkyl chains comprising from 8 to 24 carbon atoms and cyclic and polycyclic groups comprising from 8 to 60 carbon atoms;

from 35 to 75% by weight of at least one compound of formula (II) below:

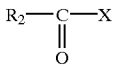

(II)

wherein $R_2$ is a saturated or unsaturated, linear or slightly branched, alkyl chain comprising from 8 to 24 carbon atoms, and X is selected from the group consisting of (i) the groups $OR_0$, wherein $R_0$ is a hydrocarbon residue comprising from 1 to 8 carbon atoms, optionally substituted by one or more ester groups, and (ii) the groups deriving from alkanolamines with a linear or branched aliphatic hydrocarbon chain comprising from 1 to 18 carbon atoms, and from 0.1 to 20% by weight of at least one glycerol diester of formula (III$_A$) and/or (III$_B$):

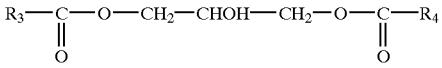

(III$_A$)

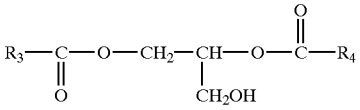

(III$_B$)

wherein $R_3$ and $R_4$ are identical or different and are selected from the group consisting of saturated or unsaturated, linear or slightly branched, alkyl chains comprising from 8 to 24 carbon atoms and cyclic and polycyclic groups comprising from 8 to 60 carbon atoms.

2. The fuel of claim 1, wherein the glycerol monoesters of formula (I) and the diesters of formula (III) with, respectively, $R_1$ or $R_3$ and $R_4$ consisting of an alkyl chain are selected from the group consisting of the monoesters and diesters obtained from the oils selected from the group consisting of lauryl oils originating from copra or palm, which are rich in saturated alkyl chains containing 12 to 14 carbon atoms, palmitic oils resulting from palm, lard or tallow, containing a major amount of saturated alkyl chains containing 16 carbon atoms, linoleic oils resulting from sunflower, maize or rape, containing a high content of linoleic acid, linolenic oils from linseed, comprising significant contents of triunsaturated alkyl chains containing up to 18 carbon atoms, and ricinoleic oils resulting from the castor oil plant.

3. The fuel of claim 1, wherein the glycerol monoesters of formula (I) and the glycerol diesters of formula (III) comprise $R_1$ or $R_3$ and/or $R_4$ composed of at least two rings, each formed of 5 to 6 atoms, at most one of which is optionally a heteroatom, and the others are carbon atoms, these atoms rings additionally having two carbon atoms in common, these said rings being saturated or unsaturated.

4. The fuel of claim 3, wherein said heteroatoms are selected from the group consisting of nitrogen and oxygen.

5. The fuel of claim 3, wherein said two carbon atoms in common are vicinal.

6. The fuel of claim 3, wherein the glycerol monoesters and diesters of formulas (I) and (III) are obtained from natural resin acids contained in the residues from the distillation of natural oils extracted from resinous trees.

7. The fuel of claim 5, wherein the esters of resin acids are selected from the group consisting of esters of abietic acid, dihydroabietic acid, tetrahydroabietic acid, of dehydroabietic acid, neoabietic acid, pimaric acid, laevopimaric acid and parastrinic acid.

8. The fuel of claim 1, wherein the esters and the amides of formula (II) are obtained by reaction of an alcohol and/or alkanolamine compound with a carboxylic acid or methyl oleate.

9. The fuel of claim 8, wherein said carboxylic acid is oleic acid.

10. The fuel of claim 8, wherein the alcohol is selected from the group consisting of methanol, ethanol, propanol, isopropanol, butanol, isobutanol, pentanol or 2-ethylhexanol and/or oxyalkylated alcohols of formula $R(O—CH_2—CHR')_n—OH$, wherein R is an alkyl group containing 1 to 6 carbon atoms, R' is hydrogen or an alkyl group containing 1 to 4 carbon atoms and n an integer varying from 1 to 5.

11. The fuel of claim 10, wherein the oxyalkylated alcohol is selected from the group consisting of methyl cellosolve, butyl cellosolve, butyl digol and 1-butoxypropanol.

12. The fuel of claim 6, wherein said resinous tree is a conifer.

13. The fuel of claim 8, wherein the alkanolamine is selected from the group consisting of amines comprising from 1 to 18 carbons atoms substituted by at least one hydroxylated, hydroxymethylated, hydroxyethylated or hydroxypropylated group.

14. The fuel of claim 13, wherein said alkanolamine is selected from the group consisting of ethanolamine, diethanolamine, triethanolamine, isopropanolamine, diisopropanolamine, triisopropanolamine, N-methylethanolamine, tris(hydroxymethyl)aminomethane, (N-hydroxyethyl)methylimidazoline and (N-hydroxyethyl) heptadecenylimidazoline.

15. A method of making the fuel of claim 1, comprising incorporating the additive into a fuel.

16. A fuel for vehicle engines, wherein the fuel comprises 25 to 2500 ppm of an additive which comprises:

from 5 to 25% by weight of at least one glycerol monoester of formulae (I$_A$) or (I$_B$):

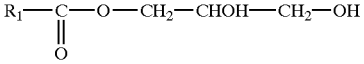

(I$_A$)

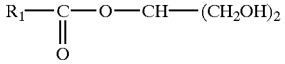

(I$_B$)

wherein $R_1$ is selected from the group consisting of saturated or unsaturated, linear or slightly branched, alkyl chains comprising from 8 to 24 carbon atoms and cyclic and polycyclic groups comprising from 8 to 60 carbon atoms;

from 35 to 75% by weight of at least one compound of formula (II) below:

(II)

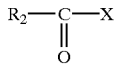

wherein $R_2$ is a saturated or unsaturated, linear or slightly branched, alkyl chain comprising from 8 to 24 carbon atoms, and X is selected from the group consisting of (i) the groups $OR_0$, wherein $R_0$ is a hydrocarbon residue comprising from 1 to 8 carbon atoms, optionally substituted by one or more ester groups, and (ii) the groups deriving from alkanolamines with a linear or branched aliphatic hydrocarbon chain comprising from 1 to 18 carbon atoms, and from 0.1 to 20% by weight of at least one glycerol diester of formula ($III_A$) and/or ($III_B$):

($III_A$)

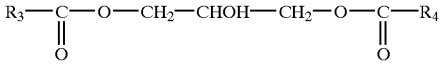

-continued ($III_B$)

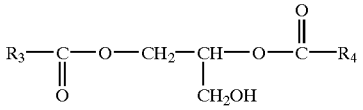

wherein $R_3$ and $R_4$ are identical or different and are selected from the group consisting of saturated or unsaturated, linear or slightly branched, alkyl chains comprising from 8 to 24 carbon atoms and cyclic and polycyclic groups comprising from 8 to 60 carbon atoms.

17. The fuel of claim 16, wherein the fuel comprises 100 to 1000 ppm by weight of the additive.

18. The fuel of claim 16, which has a low sulfur content of less than or equal to 500 ppm.

19. The fuel of claim 16, which is a diesel fuel which satisfies ASTM standard D-975.

* * * * *

UNITED STATES PATENT AND TRADEMARK OFFICE

CERTIFICATE OF CORRECTION

PATENT NO. : 6,511,520 B1
DATED : January 28, 2003
INVENTOR(S) : Eber et al.

It is certified that error appears in the above-identified patent and that said Letters Patent is hereby corrected as shown below:

Title page,
Item [87], the PCT Publication information is incorrect and should read:
-- [87] PCT Pub. No.: WO99/33938

PCT Pub. Date: July 8, 1999 --
Item [45] and Item [*], the CPA and Notice information should read as follows:
-- [45] **Date of Patent: *Jan. 28, 2003**

[*] Notice: This patent issued on a continued prosecution application filed under 37 CFR 1.53(d), and is subject to the twenty year patent term provisions of 35 U.S.C 154(a)(2).

Subject to any disclaimer, the term of this patent is extended or adjusted under 35 U.S.C. 154(b) by 0 days. --

Signed and Sealed this

Fourteenth Day of October, 2003

JAMES E. ROGAN
*Director of the United States Patent and Trademark Office*